US005375657A

United States Patent [19]

Shi et al.

[11] Patent Number: 5,375,657

[45] Date of Patent: Dec. 27, 1994

[54] CHAIN LONG-STROKE OIL-WELL PUMPING UNIT

[75] Inventors: Chaoying Shi; Kaili Song; Xinhua Li; Guanggi Gao; Juanhuan Yang; Quingkun Zeng, all of Dongying, China

[73] Assignee: Oil Production Technology Institute, Dongying, China

[21] Appl. No.: 85,939

[22] Filed: Jul. 6, 1993

[30] Foreign Application Priority Data

Jul. 5, 1992 [CN] China ..... 92106598.1

[51] Int. Cl.[5] ..... E21B 43/00

[52] U.S. Cl. ..... 166/68.5; 166/105

[58] Field of Search ..... 166/67, 68.5, 72, 73, 166/105

[56] References Cited

U.S. PATENT DOCUMENTS 4,456,060 6/1984 Stanton ..... 166/68.5

*Primary Examiner*—William P. Neuder

*Attorney, Agent, or Firm*—Beveridge, DeGrandi, Weilacher & Young

[57] ABSTRACT

The invention relates to oil recovery equipment improved from existing chain oil-well pumping units. Double suspending cables, double balance flexible cables and a counterweight structure without inertial load are used in the invention. There are guide buffer devices and a buffer eccentric regulation shaft coupling in the apparatus according to the invention. Consequently, the load distribution and the stressed condition are more reasonable, the structure is simplified and reliable, and power is obviously economized. The invention has the striking strong points mentioned above in recovering condensed oil, high-condensed oil and bathhypelagic oil.

20 Claims, 9 Drawing Sheets

CHAIN LONG-STROKE OIL-WELL PUMPING UNIT

TECHNICAL FIELD

The invention is a new generation of oil recovery equipment.

BACKGROUND

A chain oil-well pumping unit as disclosed in CN Patent Application No. 86102979 includes five subunits:

(1) Driving system including motor, pulley, speed reducer and shaft coupling;

(2) Reversing system including drive chain wheel, upper chain wheel, locus chain, main shaft pin, special chain element, slide block and reciprocating rack.

(3) Counterweight system including counterweight chain, counterweight chain wheel, counterweight trunk piston, counterweight cylinder, gas energy accumulator, oil pump and air compressor.

(4) Suspension system including cable suspension, steel cable and pulleys.

(5) Framework including base, speed reducer base and framework body.

The Driving Principle: The motor drives the drive chain wheel through the belt and speed reducer. The locus chain moves vertically between the drive chain wheel and the upper chain wheel. The special chain element on the locus chain drives the reciprocating rack through the main shaft pin and the slide block. The rack moves up, down and reciprocally along the path as the locus chain moves annularly. The steel cable is linked at the central position with the top end of the reciprocating rack and linked with the cable suspension through the pulley. The cable suspension is linked with the polish rod so that the vertically reciprocating motion of the rack causes the up-down stroke of the rod. The counterweight chain is linked at the central position of the lower end of the reciprocating rack and linked with the pneumatic counterweight system to realize the balance of the oil-well pump unit. The unit has strong points such as long stroke, lower stroke times, high efficiency, large loading and electrical efficiency. However, its structure is complicated, there is a tilting moment vertical to the chain moving plane in the reciprocating rack and the pneumatic counterweight system malfunctions easily, the eccentricity of the shaft coupling can not be regulated, shock is serious in reversing, the load center is off the frame, stability is lower, and maintenance is difficult, etc. Therefore, its development has been limited.

OBJECTIVES OF THE INVENTION

One objective of this invention is to simplify the structure and to improve the reliability of a chain long-stroke oil-well pumping unit.

Another objective of this invention is to remove the tilting moment vertical to the chain moving plane of the reciprocating rack, to improve the stressed condition of the locus chain, the guide of the rail and the contact roller, and to remove the reversing shock of the rack in the reciprocal direction.

Another objective of this invention is to improve counterweight reliability and its effect.

Another objective is to provide a shaft coupling with both adjustable eccentricity and vibration reduction.

Another objective is to reduce the reversing shock between the reciprocating rack and the guide rail.

Another objective is to improve the stability of the unit.

SUMMARY OF THE INVENTION

The objectives of the invention may be realized as follows. The ends of two suspending cables and two counterweight flexible cables are linked with the reciprocating rack. They are linked onto the polish rod connector and the counterweight connector or pneumatic counterweight connector at the other ends, respectively. There are suspended connection arms for the suspending cables and flexible cables in the reciprocating rack. There are buffer devices in the counterweight unit. There are four guide buffer devices at the four corners of the rack. The gear shaft coupling linked by an elastic pin is assembled between the speed reducer and the driving chain wheel. The crown block wheel supporter, rotating in the horizontal direction within 0–180 degrees, is hinged with the upper part of the framework.

The detailed description of the chain long-stroke oil-well pumping unit follows, in conjunction with the accompanying drawings:

FIGS. 1*a* and 1*b* are a structural diagram and side view, respectively, of this invention concerning a chain long-stroke oil-well pumping unit.

FIGS. 2*a* and 2*b* are load analysis diagrams of the reciprocating rack of a unit in the prior art.

FIGS. 3*a* and 3*b* are load analysis diagrams of the reciprocating rack of this invention.

DETAILED DESCRIPTION OF THE INVENTION

Figure 2A:
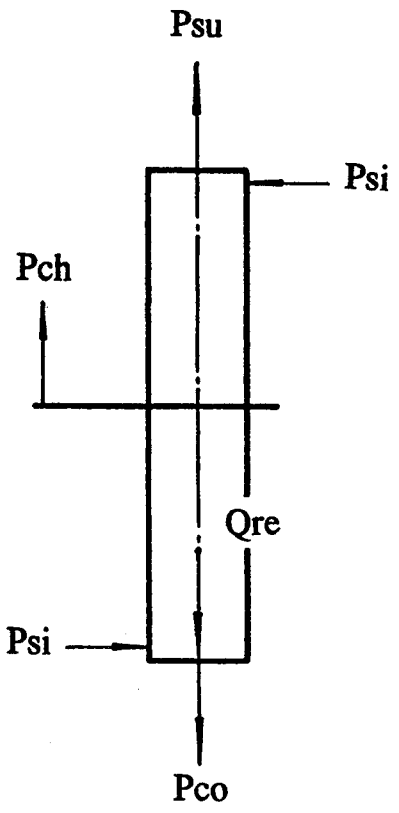
Fig. 2a PRIOR ART
Figure 2B:
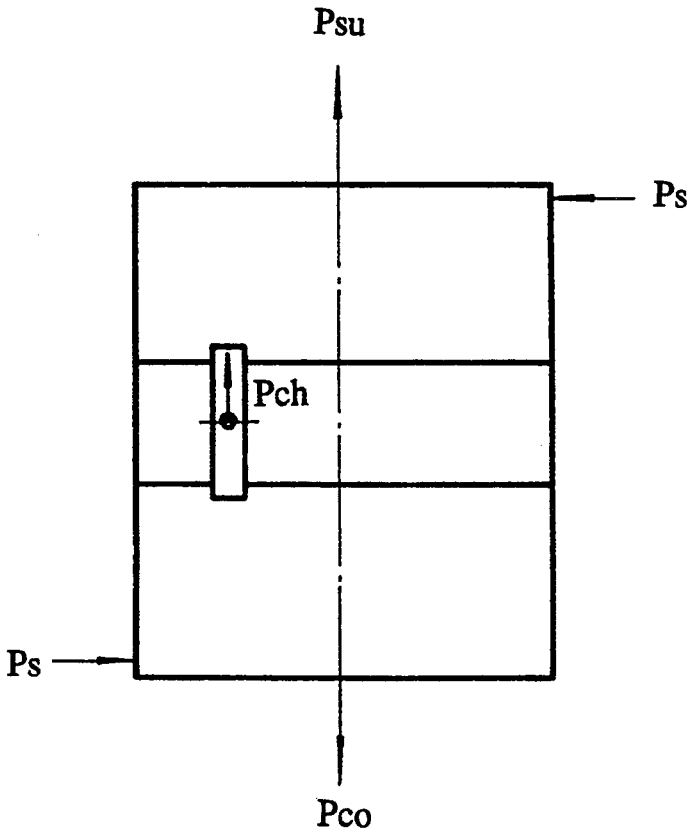
Fig. 2b PRIOR ART
Figure 3A:
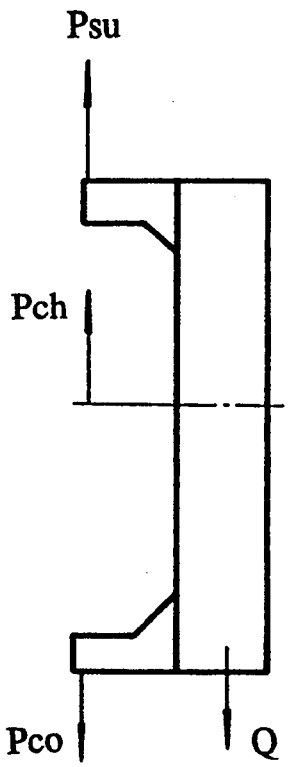
Figure 3B:
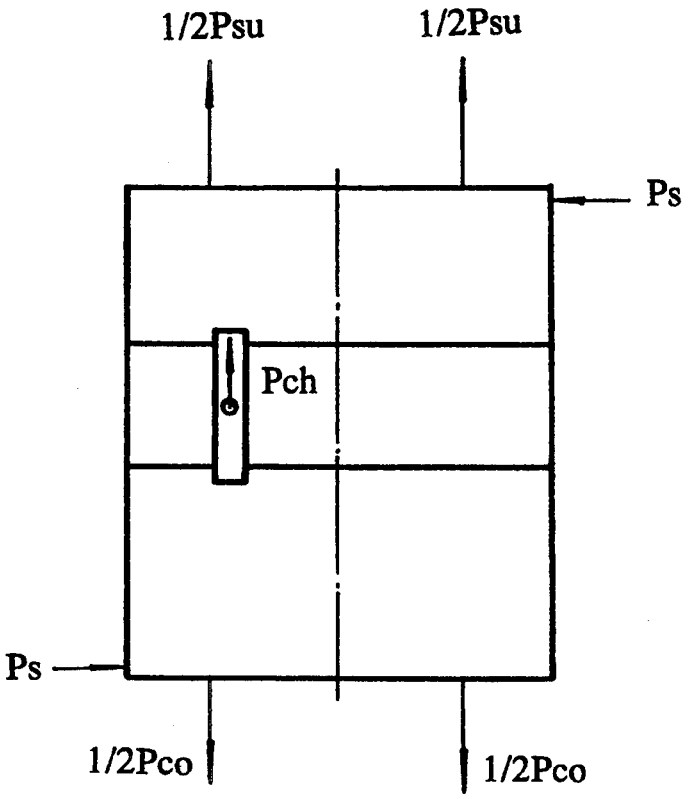

The load analysis of the reciprocating rack in the prior art is shown in FIGS. 2*a* and 2*b*. In the direction vertical to the driving plane (or the reciprocating rack) of the locus chain, locus chain force Pch, suspending cable force Psu, counterweight chain force Pco and weight Qre of the reciprocating rack form a cantilever so that a tilting moment is produced. The moment produces a bending moment on the chain plate of the locus chain near the special chain element to cause the locus chain to be frequently broken and off the wheel. Under the action of the moment, the reciprocating rack gives a lateral force Psi to the guide rail through the contact roller and the forces Ps for a stroke are opposite in direction during the upward stroke and the downward stroke, respectively. Therefore, the abrasion of the side-face of the guide rail is serious, and the shock is very strong in reversion.

The technical solution according to this invention is shown in FIGS. 1*a*, 1*b*, 3*a* and 3*b*. There is a suspending connection arm in the reciprocating rack, and it can be made as a whole with the reciprocating rack or connected as a whole with the reciprocating rack by a connector. Two suspending cables and two counterweight flexible cables are connected with the reciprocating rack through the connection arm. The other ends of the two suspending cables are connected with the polish rod through the crown block wheel and the polish rod connector to realize the reciprocating up and down motion of the oil-well pumping rod. When the oil-well pumping unit is counterweighted by a counterweight, the other ends of the two counterweight flexible cables are connected with the counterweight basket through the upper and lower fixed pulleys fixed on the framework and the counterweight connector to realize a counterweight and balance. When the pneumatic counterweight is used in the oil-well pumping unit, the other ends of the two counterweight flexible cables can be connected with the framework through the reversed pneumatic trunk-piston or the drive pulley linked with the pneumatic cylinder and the pneumatic counterweight connector so that a pneumatic counterweight is realized. The connection points between the two suspending cables and two counterweight flexible cables and the reciprocating rack are at both sides of a ring made by the locus chain. The four connection points are all on the driving plane of the locus chain and the reciprocating rack, or are on a plane keeping a certain distance from the driving plane and parallel to the driving plane and in the direction away from the reciprocating rack when the weight of the reciprocating rack is considered. Consequently, the tilting moment of the reciprocating rack in the direction vertical to the driving plane of the locus chain can be eliminated (Psi=0), and the stressed condition of the whole unit is improved, the service life of the chain is also increased and the reversed shock and abrasion of the guide rail are reduced.

Figure 4:
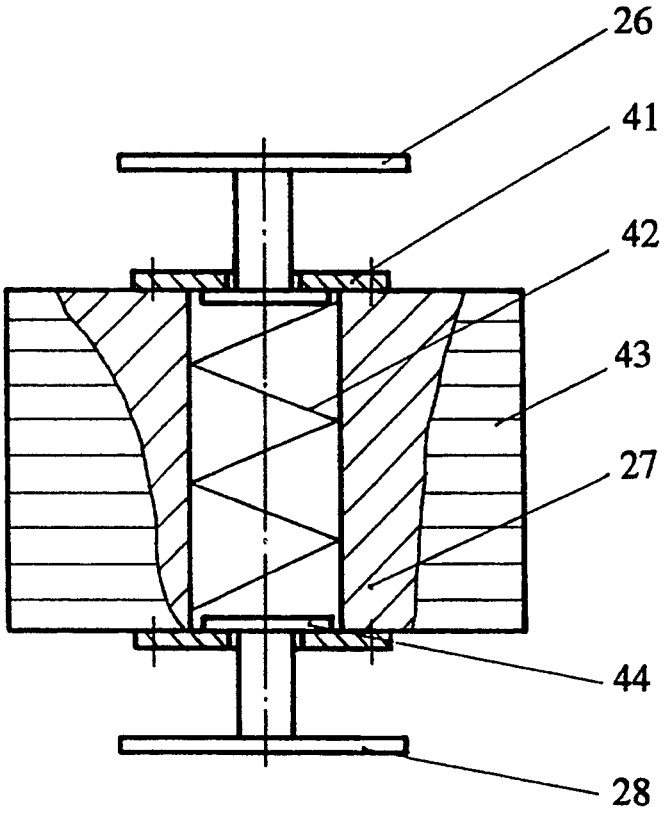
FIG. 4 is a structural diagram showing the counterweight basket of this invention.

The malfunction of the counterweight system of conventional oil-well pumping units occurs frequently. Its structure is complicated, maintenance is inconvenient and gas leakage is serious so that disequilibrium occurs frequently. The inertial load of the counterweight in reversing can not be eliminated by the counterweight used in conventional oil-well pumping units so that the shock is large in reversing, equilibrium force is non-uniform and the expenditure of energy is high. The way to solve the problems in accordance with this invention is that a counterweight with a buffer device is used (as shown in FIG. 4). The counterweight includes the counterweight basket, counterweight block and buffer device. The buffer device consists of an upper stopper, lower stopper, spring, clip, upper supporter, lower supporter and guide device. The spring is fixed in the guide device of the counterweight basket or is in the guide hole of the counterweight basket. The upper clip, lower clip, upper supporter, and lower supporter are connected as a whole and fitted on the top and the bottom of the spring. The upper stopper and lower stopper are respectively fitted on the top and on the bottom of the framework, and the connection position can be adjustable up and down. When the counterweight basket moves upward and reaches the top, the upper supporter is blocked by the upper stopper and the counterweight basket moves continuously upward, and the upper supporter presses the spring through the upper clip. The spring is released when the counterweight basket moves downward and reaches the bottom, the lower supporter is blocked by the lower stopper. When the counterweight basket moves continuously downward, the lower supporter presses the spring through the lower clip so that the buffer effect of the counterweight in reversing is realized, the inertial load of the counterweight flexible cable added by the counterweight is eliminated, the stressed condition of the counterweight flexible cable is uniform and the power expenditure is reduced. The counterweight equilibrium of the buffer device of the counterweight device is equivalent to the pneumatic equilibrium, the structure of the former is simpler than that of the latter, and the former is more reliable and more maintainable than the latter.

Figure 5:
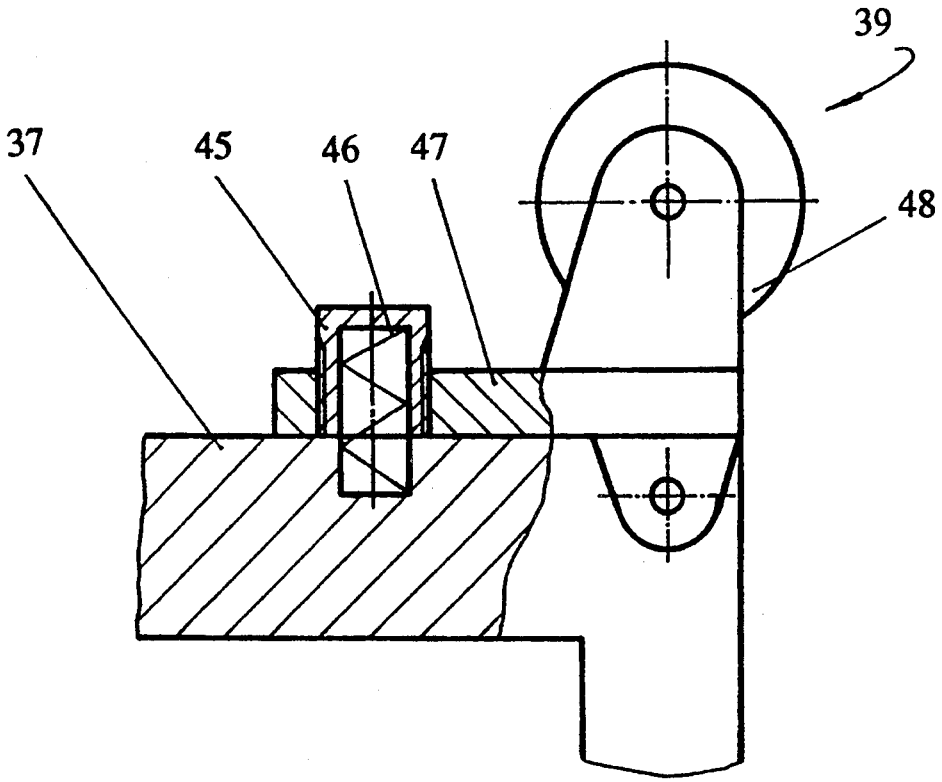
FIGS. 5 and 6 are structural diagrams showing the guide buffer devices of this invention.
Figure 6:
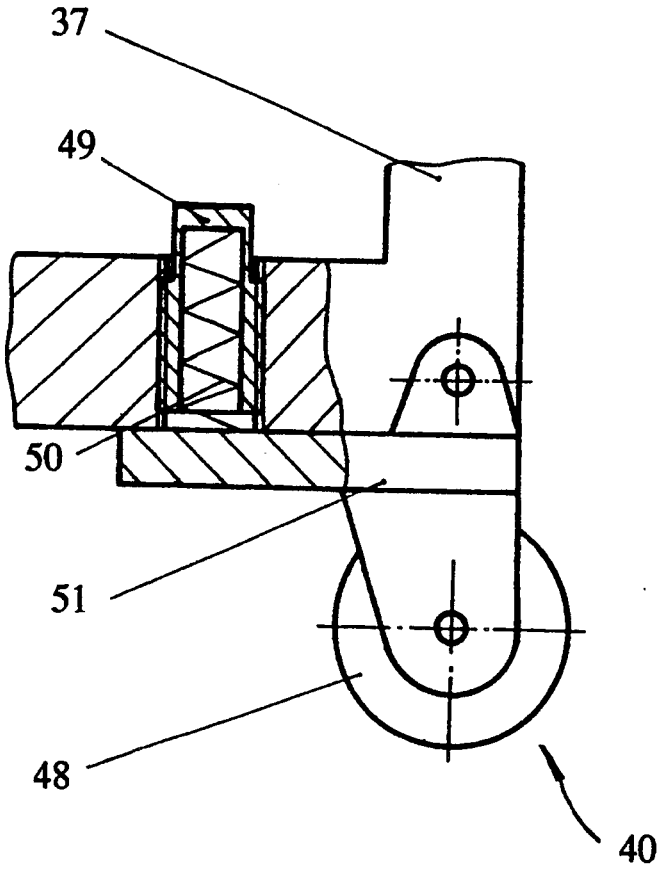

To reduce the shock against the guide rail by the reciprocating rack in reversing, there are four guide buffer devices in the reciprocating rack (see FIG. 5). The contact roller is hinged with its supporter. One end of the supporter of the contact roller is hinged with the reciprocating rack and the other end is screwed with the spring press cap. The inner face of the press cap presses the spring through the supporter or presses it without using the supporter. The other technical solution of the buffer device is shown in FIG. 6. The one end of the supporter of the contact roller is connected with the reciprocating rack. The spring press cap is screwed to the reciprocating rack, and the spring presses the supporter of the contact roller. Under the action of the spring force, the contact wheel touches the guide rail through the supporter when the spring is pressed by turning the spring press cap. Therefore, the spring absorbs the shock of the reciprocating rack when reversing, and the shock can not be transferred to the guide rail. The structure of the device is simple and the spring is easily replaced.

Figure 7:
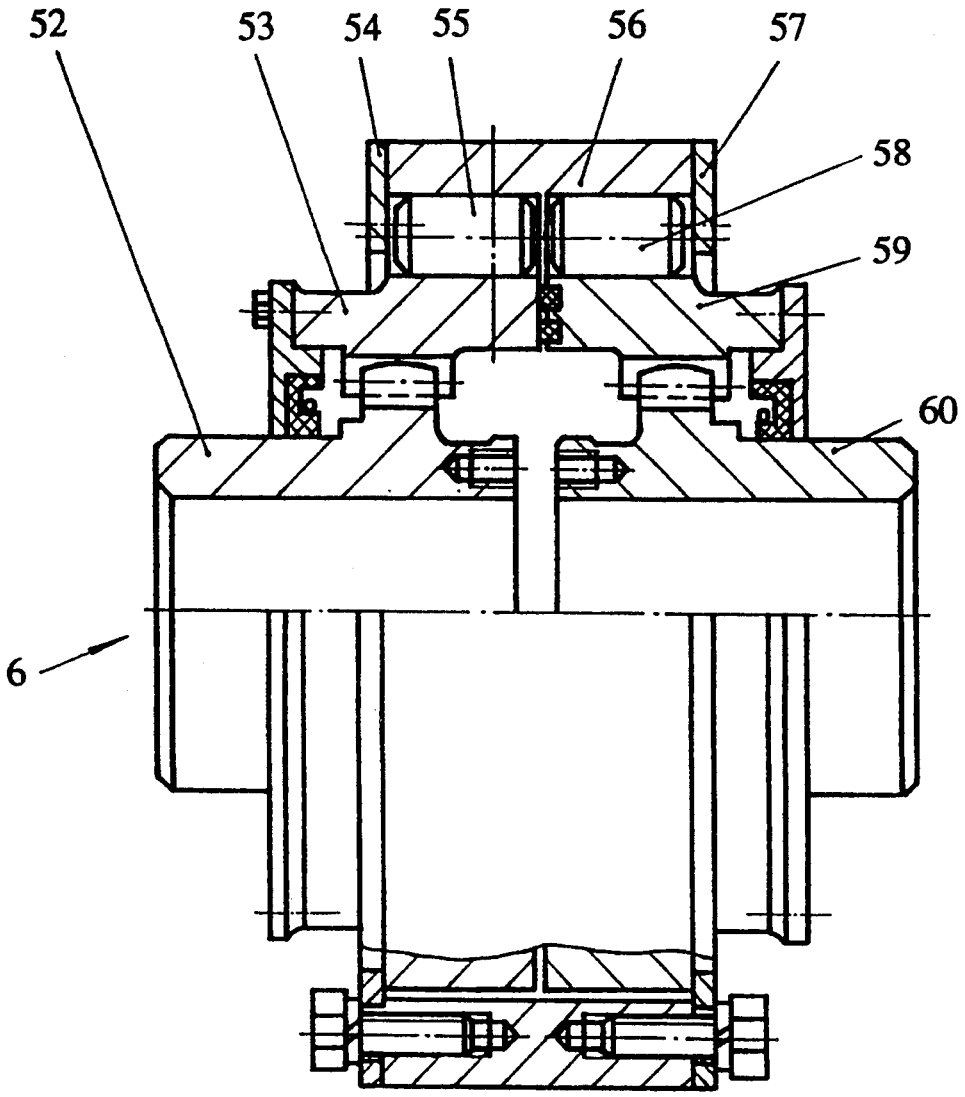
FIG. 7 is a structural diagram showing the shaft coupling of this invention.

The gear shaft coupling connected by the pins is shown in FIG. 7. The coupling is between the speed reducer and the driving chain wheel. The output moment of the speed reducer transfers the right external tooth shaft sleeve with drum-formed teeth through the left external tooth shaft sleeve, the left internal tooth ring, the left elastic pin, the external sleeve, the right elastic pin and the right internal tooth ring, so that the elastic connection between two shafts is realized and the radial and angular displacements are also regulated. The buffer performance of the coupling is very good and its regulation range is large in the radial and circumferential directions.

Figure 8:
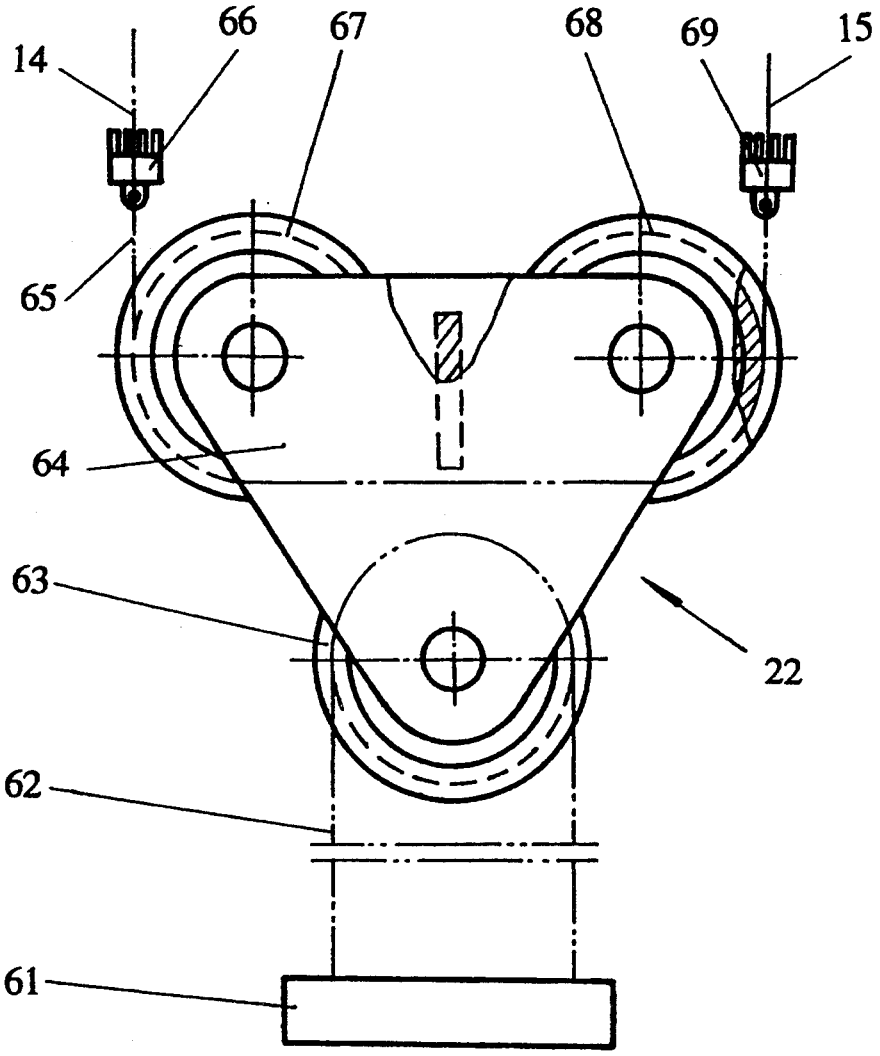
FIG. 8 is a structural diagram showing the polish rod connector of this invention.

Referring to FIG. 8, the polish rod connector includes upper and lower pulleys, the pulley supporters, the pins, the reversing connector, upper and lower flexible parts and the cable suspension. The upper and lower pulleys are connected with the pulley supporter through the pins. Two ends of the upper flexible parts are connected with the reversing connectors through the upper pulley. Two ends of the lower flexible parts are connected with the cable suspension through the lower pulley. The winding direction of the suspending cable around the flexible parts is reversed by the reversing connector. Such technical solution can eliminate the non-uniform stressed condition caused by the different elongation of two suspending cables. When either of the suspending cables is broken or off the pulley, the reversing connector is blocked by the lower pulley and the connector on the top of the wheel supporter to avoid the malfunction of the whole unit caused by the lost load of the other suspending cable.

Figure 9:
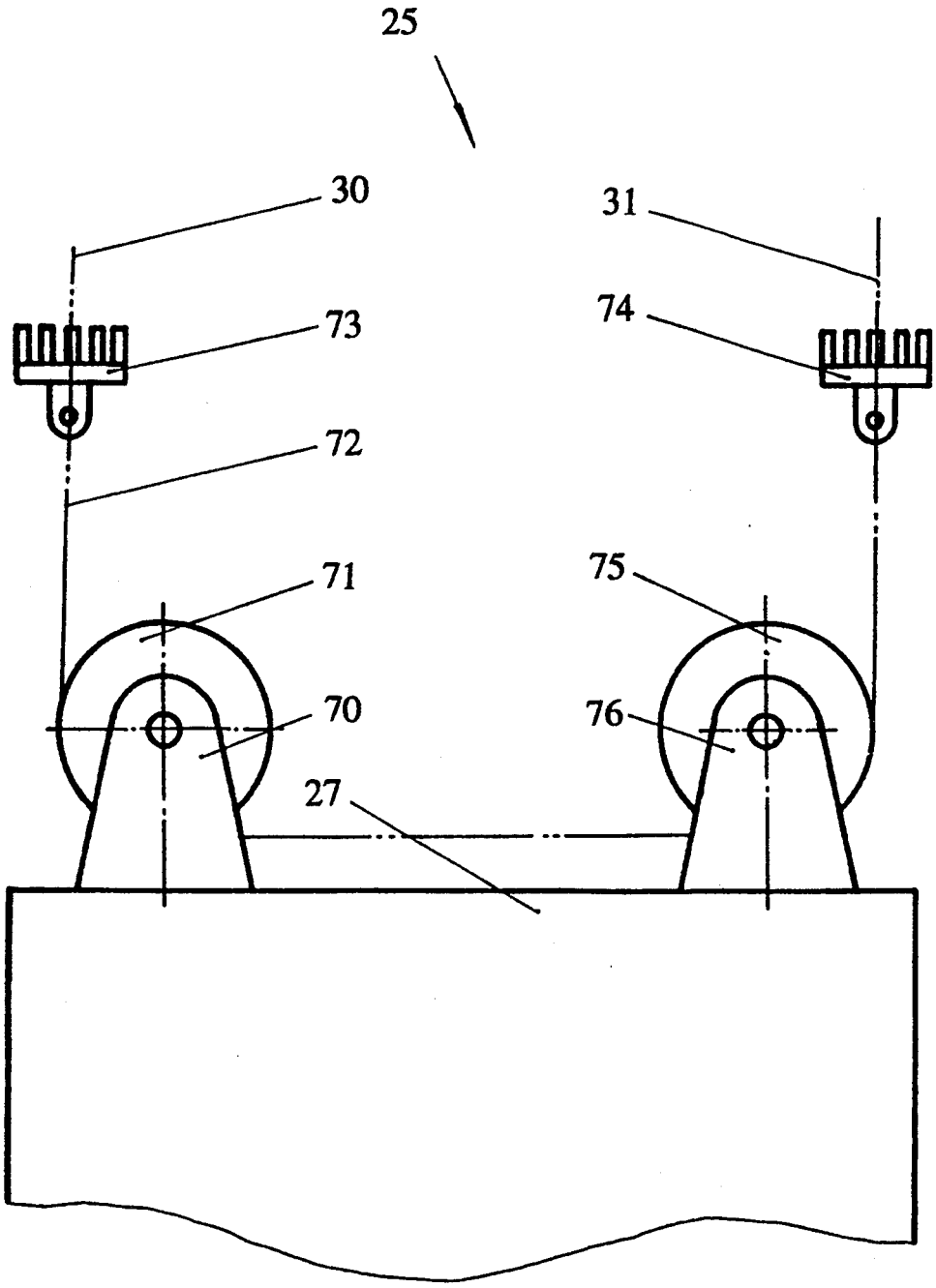
FIG. 9 is a structural diagram showing the counterweight connector of this invention.

The counterweight connector is shown in FIG. 9. The counterweight connector includes the reversing connector, the flexible part, pulley, supporter and pin. The pulley is hinged with the supporter through the pin. The supporter is connected with the counterweight basket. Two ends of the flexible part are connected with the reversing connector and are blocked by the pulley and the counterweight when either of the counterweight flexible cables is broken or off the pulley, to avoid the malfunction of the counterweight falling when either of the suspending cables is broken or off the pulley.

The difference between the pneumatic connector and the counterweight connector is that in the former the supporter is connected with the framework.

The polish rod connector, the counterweight connector and the upper end of the reversing connector of the pneumatic counterweight connector are connected with the suspending cable or the counterweight flexible cable, and its lower end is connected with the flexible part. The winding direction of the suspending cable, counterweight flexible cable and the flexible part is 0–180 degrees.

The polish rod connector, the counterweight connector and the pneumatic counterweight connector can also be a link lever or a link plate reverse device. It includes the horizontal part, the vertical part and the pins. The top end of the vertical part is hinged with the horizontal part at a central point (the central points can be one or more), and the lower end is hinged with the cable suspension or the counterweight basket or the framework. Both ends of the horizontal part are hinged with the suspending cable or the counterweight flexible cable.

The crown block wheel supporter stretched out of the upper end of the framework is hinged with the framework. The supporter can be integral or separate. It can horizontally turn toward one side of the framework by 0–180 degrees when it is integral. It can turn toward both sides of the framework by 0–180 degrees so that there is a larger space for operation when the pumping oil rod is lifted and lowered.

The suspending cable, the counterweight flexible cable and the flexible part are all chain or belt.

The loading center of the oil-well pumping unit is within the framework and reversing shock is greatly reduced so that the stability of the whole unit is improved.

The structural layout of the chain long stroke oil-well pumping unit is reasonable, the moving speed of the suspending point is uniform, the efficiency for pumping oil is high, the structure is simple and maintenance is easy. The unit is suitable for recovering condensed oil, high-condensed oil, and oil in deep.

The details of the preferred embodiment of the invention are described below, with the accompanying drawings.

The load at the suspending point is 140 KN, the stroke is 6 meters and counterweighting is used in the illustrated embodiment.

Figure 1A:
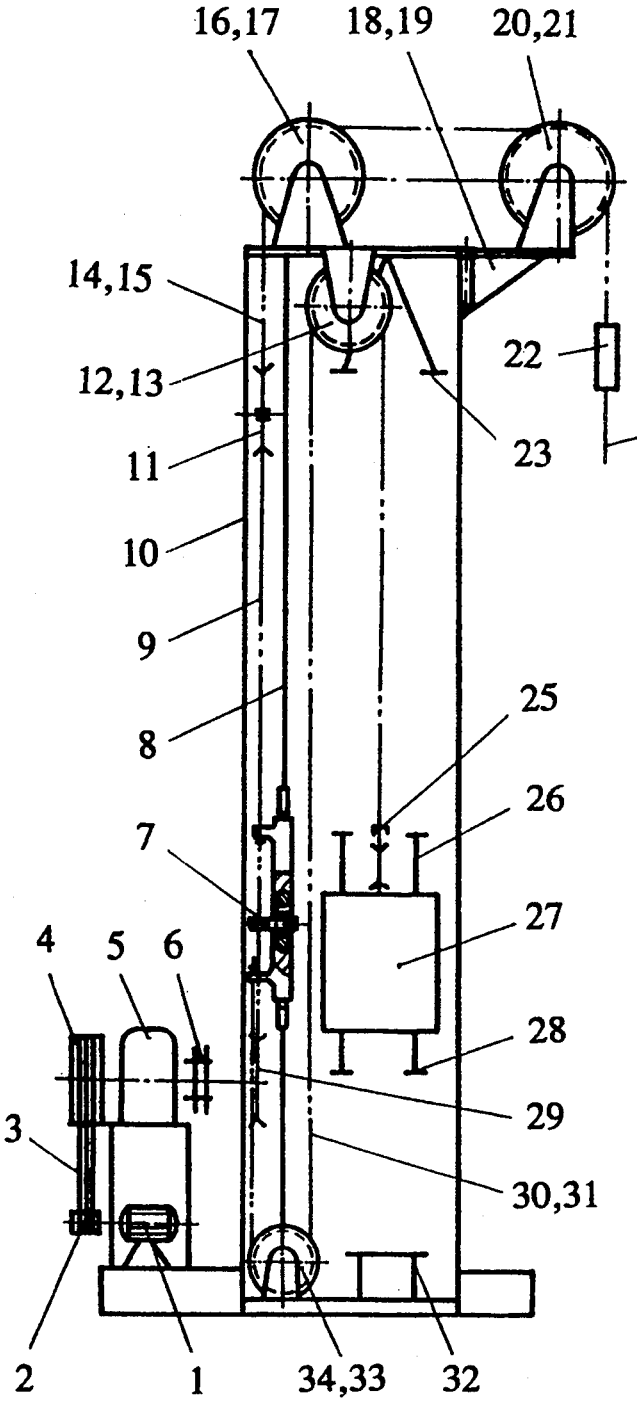
Figure 1B:
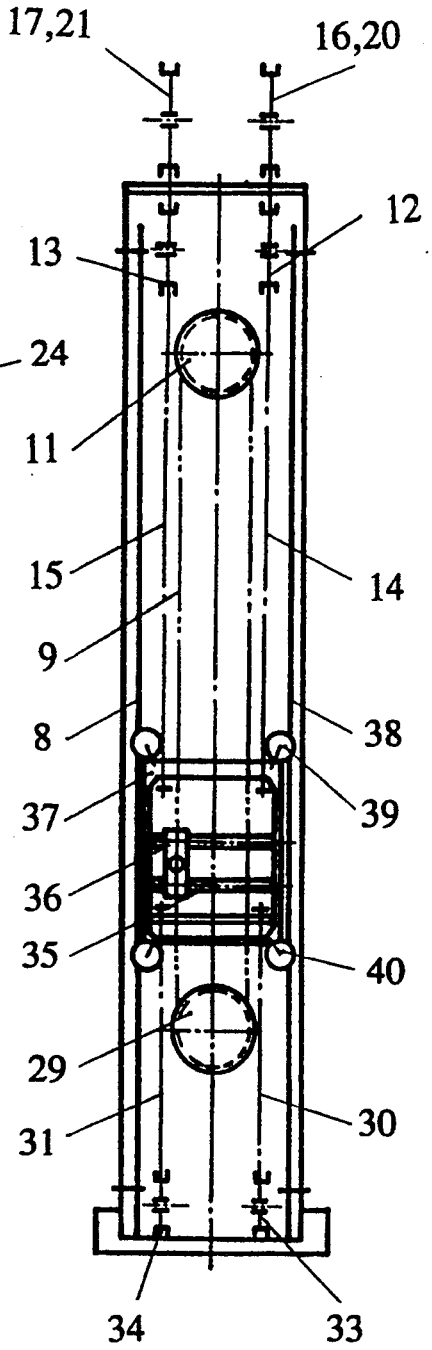

As shown in FIGS. 1*a* and 1*b*, motor 1 and the speed reducer base are both connected with the base of framework 10. Speed reducer 5 is mounted on the speed-reducer base. Driving chain wheel 29, driven chain wheel 11, upper and lower counterweight chain wheels 12, 13, 33 and 34, and upper and lower stoppers 23 and 32, are all fixed on the framework. Motor 1 drives driving chain wheel 29 through small belt wheel 2, belt 3, large belt wheel 4, speed reducer 5 and shaft coupling 6 so that the chain transmission with a close locus is formed between driving chain wheel 29 and driven chain wheel 11. A special chain pin 7 capable of linking any element of chain 9 is inserted into the slide block 36 sliding on the slide rod 35 of the reciprocating rack 37 to move the reciprocating rack 37 along guide rails 8, 38. At the upper part of the reciprocating rack 37, right and left sides of the locus chain 9 are connected with two symmetrically arranged suspending cables 14 and 15. The connection points between the two suspending cables and reciprocating rack 37 are all on the driving plane of locus chain 9. Two suspending cables 14 and 15 pass through the crown block wheels 16, 17, 20 and 21 on the upper part of the framework and are connected with the polish rod 24 through the polish rod connector 22 to realize the up-down stroke of the suspending points. The right and left sides formed by the lower part of the reciprocating rack 37 and locus chain 9 are connected with two symmetrically arranged counterweight flexible cables 30 and 31. The connection points between two counterweight flexible cables 30 and 31 and reciprocating rack 37 are all on a plane away from the reciprocating rack 37 and parallel to the driving plane of the locus chain, and keep a certain distance from the driving plane. The other ends of the two counterweight flexible cables 30 and 31 are connected with counterweight basket 27 through upper and lower fixed pulleys (also called counterweight chain wheels) 12, 13, 33 and 34, and the counterweight connector 25 to realize the counterweight of the unit. The winding direction of the two suspending cables 14 and 15 and the two counterweight flexible cables 30 and 31 are both vertical to the driving plane of locus chain 9.

As shown in more detail in FIGS. 4, there are several counterweights 43, spring, 42, upper and lower clips 41, 44, and upper and lower supporters 26, 28 in the counterweight basket 27. One group or more groups of springs 42 are in the guide holes of the counterweight basket 27. The pressed spring stroke is greater than or equal to the length of radii of the driving chain wheel 29 and the driven chain wheel 11. Upper and lower clips 41 and 44 and upper and lower supporters 26 and 28 are made into a whole and mounted at the top and bottom of springs 42, respectively. When the counterweight basket 27 moves up and reaches the upper limitation position equal to the length of the radii of drive and driven chain wheels 29 and 11, upper supporter 26 touches upper stopper 23. While counterweight basket 27 continuously moves up, the upper supporter 26 presses spring 42. When the counterweight basket 27 reaches the upper limitation position and starts to move down, spring 42 is released. In the same way, when counterweight basket 27 moves down and reaches the lower limitation position, lower supporter 28 touches lower stopper 32, and spring 42 is pressed and released, respectively. There are two vertical limit guide rails in framework 10 which keep a certain gap from the counterweight basket 27. The counterweight basket 27 can not touch the limit guide rails when it moves up and down without swaying. On the contrary, the counterweight basket touches the limit guide rails when it sways. Therefore, swaying of the counterweight basket must be avoided.

Upper guide buffer devices 39 are mounted at the two upper corners of reciprocating rack 37 (see FIG. 5). Contact roller 48 is hinged with contact roller supporter 47. The end of contact roller supporter 47 is hinged with reciprocating rack 37, and the other end is screwed with spring press cap 45. The inner face of spring press cap 45 presses spring 46 in reciprocating rack 37. Lower guide buffer devices 40 are mounted at the two lower corners of reciprocating rack 37 (see FIG. 6). Except for the fact that spring 50 is in the hole of the reciprocating rack 37, the connection of contact roller 48, supporter 51 and reciprocating rack 37 is the same as the connection in upper guide buffer devices 39. The lower base is on the other end of contact roller supporter 51, and its upper end touches the inner face of spring press cap 49 which is screwed with reciprocating rack 37.

External gear sleeve 52 of elastic adjustable eccentric shaft coupling 6 is covered over the output shaft of the speed reducer. As shown in FIG. 7, the external gear is engaged with the internal gear of left internal gear ring 53. Left and right elastic pins 55 and 58 are mounted in the holes formed by left and right internal gear rings 53 and 59 and external sleeve 56, respectively. The inner gear of right internal gear ring 59 is engaged with the external gear of right external gear sleeve 60 which is covered over the driving chain wheel shaft. Left and right aprons 54 and 57 are mounted at the two ends of external sleeve 56 to avoid breaking away of elastic pins 55 and 58.

As shown in FIG. 8, two ends of upper flexible part 65 of polish rod connector 22 linking two suspending cables are connected with reversing connectors 66 and 69, through upper pulleys 67 and 68, respectively. Two ends of lower flexible part 62 are connected with cable suspension 61, which is connected with polish rod 24. Suspending cables 14 and 15 and flexible part 65 are connected together through reversing connectors 66 and 69 and vertically to the winding direction.

The counterweight connector 25 is shown in FIG. 9. Pulleys 71 and 75 are connected with supporters 70 and 76 through pins. Supporters 70 and 76 are connected with counterweight basket 27. The two ends of flexible part 72 are connected with reversing connectors 73 and 74 through pulleys 71 and 75. Counterweight flexible cables 30 and 31 and flexible part 72 are connected together by reversing connectors 73 and 74.

There are two crown block wheel supporters 18 and 19 stretched out of framework 10 and right over polish rod 24. See FIG. 1*a*. Crown block wheels 20 and 21 are mounted on supporters 18 and 19, respectively. Both sides of the supporters are hinged with framework 10. The hinging shafts on the internal side of the supporters are stretched out and rotated horizontally toward the two sides of the framework by 90–180 degrees when the oil-well pumping unit works.

Sleeve roller chains or plate chains are used in suspending cables 14 and 15, counterweight flexible cables 30 and 31 and flexible parts 62, 65 and 72.

The chain long-stroke oil-well pumping unit provided in the invention can be used in various kinds of pumping oil-wells. Particularly the unit in accordance with the invention may be used in pumping deep oil-wells, in recovering oil with large output volume and in recovering condensed oil. In comparison with a beam oil-well, the unit provided in the invention can economize power by 30%, and economize steel material by 60%. Besides, the weight of the unit is light, its transportation is convenient and the place occupied by it is smaller in operation. Consequently, the unit provided in the invention is a new type of power saving oil recovery equipment.

What is claimed is:

1. A chain long-stroke oil-well pumping unit comprising: a framework, a driving system, a reversing system operatively connected to the driving system, a counterweight system connected to the framework, and a suspension system supporting the reversing system and the counterweight system, wherein:

a first end of each of two suspending cables and two counterweight flexible cables is linked with a reciprocating rack of the reversing system; a second end of each of the two suspending cables is linked with a polish rod connector of the reversing system, and a second end of each of the two counterweight flexible cables is linked with a counterweight connector or a pneumatic counterweight connector;

the reciprocating rack includes a suspending connection arm for connecting the suspending cables and the counterweight flexible cables to the reciprocating rack;

the counterweight system includes a buffer device having a spring, an upper clip, a lower clip, an upper supporter, a lower supporter, a guide device, an upper stopper, and a lower stopper;

the driving system includes a speed reducer which is connected to a driving chain wheel by a gear shaft coupling;

the reciprocating rack includes guide buffer devices, wherein the guide buffer devices include a contact roller, a contact roller supporter, a spring, a spring press cap, and a spring supporter; and a crown block wheel supporter, rotatable within 0–180 degrees, is connected at an upper part of the framework.

2. The unit as claimed in claim 1, wherein the first ends of the two suspending cables are linked with the suspending connection arm of the reciprocating rack and are arranged at the sides of a ring formed by a locus chain of the reversing system; the second ends of the two suspending cables are connected with the polish rod connector winding over a crowned block wheel located at a top portion of the framework.

3. The unit as claimed in claim 1, wherein the first ends of the two counterweight flexible cables are linked with the suspending connection arm of the reciprocating rack and are arranged at the sides of a ring formed by a locus chain of the reversing system; the second ends of the two counterweight flexible cables are connected with the counterweight connector by winding over an upper fixed pulley and a lower fixed pulley, or the second ends of the two counterweight flexible cables are connected with the framework by winding over a driving pulley and connecting with the framework through the pneumatic counterweight connector.

4. A unit as claimed in claim 1, wherein the suspending connection arm of the reciprocating rack and the reciprocating rack are made up as a single unit or are connected together as a single unit by a connector, wherein connection points with the suspending cables and the counterweight flexible cables are on a plane parallel to a driving plane of a locus chain, keeping a distance from the driving plane, or on the driving plane of the locus chain.

5. A unit as claimed in claim 1, wherein the guide buffer devices are connected to the reciprocating rack through the spring of the guide buffer devices.

6. A unit as claimed in claim 1, wherein the upper supporter and the lower supporter of the buffer device and the upper clip and the lower clip of the buffer device are linked into a single unit, wherein the upper clip and the lower clip are above and below the spring of the buffer device, respectively, and wherein the upper supporter and the lower supporter contact the upper stopper and the lower stopper when the buffer device moves up and down, respectively.

7. A unit as claimed in claim 6, wherein the upper stopper is connected at an upper position of the framework, and the lower stopper is connected at a lower position of the framework, wherein the upper position and the lower position are adjustable.

8. A unit as claimed in claim 1, wherein the contact roller of the guide buffer device is connected with the contact roller supporter; a first end of the contact roller supporter is connected to the reciprocating rack; a second end of the contact roller supporter is connected to the spring press cap, such that the spring of the guide buffer device is pressed on the reciprocating rack by the spring press cap.

9. A unit as claimed in claim 1, wherein the polish rod connector includes an upper pulley, a lower pulley, a pulley supporter, pins, a reversing connector, an upper flexible part, a lower flexible part, and a cable suspension; wherein the upper pulley and the lower pulley are connected with the pulley supporter by the pins, the upper flexible part is connected with the reversing connector and the lower flexible part is connected with the cable suspension.

10. A unit as claimed in claim 1, wherein the counterweight connector includes a reversing connector, a flexible part, a pulley, a supporter and a pin; wherein the pulley is connected to the supporter and the supporter is connected with a counterweight basket of the counterweight system, and the flexible part is connected with the reversing connector and wound around the pulley.

11. A unit as claimed in claim 1, wherein the pneumatic counterweight connector includes a pulley, a supporter, a reversing connector, a flexible part and a pin; wherein the pulley is connected to the supporter by the pin; the supporter is connected with a counterweight basket of the counterweight system; and the flexible part is connected with the reversing connector and wound around the pulley.

12. A unit as claimed in claim 1, wherein an upper end of a reversing connector of the counterweight connector or the pneumatic counterweight connector is connected with the suspending cable or the counterweight flexible cable, and a lower end of the reversing connector is connected with a flexible part of the counterweight connector or the pneumatic counterweight connector.

13. A unit as claimed in claim 1, wherein an elastic pin of the gear shaft coupling connects an inner gear ring of the gear shaft coupling with an external sleeve of the driving chain wheel.

14. A unit as claimed in claim 1, wherein the crown block wheel supporter includes a front supporter located on the upper part of the framework, wherein the front supporter is connected with the framework such that it can be horizontally rotated toward one side or both sides by 0–180 degrees.

15. A unit as claimed in claim 1, wherein the polish rod connector, the counterweight connector or the pneumatic counterweight connector can be either a connecting rod reversing device or a connecting plate reversing device, wherein the connecting rod reversing device and the connecting plate reversing device each include a horizontal part, a vertical part and a pin, wherein the horizontal part is connected with an upper end of the vertical part at a central hinging point; and a lower end of the vertical part is connected with the suspending cable or a counterweight basket of the counterweight system or the framework; wherein each end of the horizontal part is connected to the suspending cable or the counterweight flexible cable.

16. A chain long-stroke oil-well pumping unit comprising:

a framework;

a driving system;

a reversing system operatively connected to the driving system, the reversing system including a reciprocating rack and a polish rod connector;

a counterweight system connected to the framework, the counterweight system including a counterweight connector or a pneumatic counterweight connector, wherein the counterweight system includes a counterweight basket around a spring, wherein an upper clip and a lower clip hold the spring in the counterweight basket, and an upper supporter and a lower supporter extending from the counterweight basket and contacting the spring through the upper clip and the lower clip, respectively;

wherein:

a first end of each of two suspending cables and two counterweight flexible cables is linked with the reciprocating rack of the reversing system at a suspending connection arm of the reciprocating rack; a second end of each of the two suspending cables is linked with the polish rod connector, and a second end of each of the two counterweight flexible cables is linked with the counterweight connector or the pneumatic counterweight connector;

guide buffer devices are provided on the reciprocating rack, wherein the guide buffer devices include a contact roller supporter connected to the reciprocating rack, a spring and a spring press cap connecting the contact roller supporter and the reciprocating rack, and a contact roller attached to the contact roller supporter.

17. A unit as claimed in claim 16, wherein the framework includes an upper stopper and a lower stopper attached thereto, wherein the upper supporter and the lower supporter of the counterweight system contact the upper stopper and the lower stopper, respectively, when the counterweight basket moves up and down.

18. A unit as claimed in claim 16, wherein the polish rod connector includes an upper pulley, a lower pulley, a pulley supporter, pins, a reversing connector, an upper flexible part, a lower flexible part, and a cable suspension; wherein the upper pulley and the lower pulley are connected with the pulley supporter by the pins, the upper flexible part is connected with the reversing connector and the lower flexible part is connected with the cable suspension.

19. A unit as claimed in claim 16, wherein the counterweight connector includes a reversing connector, a flexible part, a pulley, a supporter and a pin; wherein the pulley is connected to the supporter by the pin, the supporter is connected with the counterweight basket, and the flexible part is connected with the reversing connector and wound around the pulley.

20. A unit as claimed in claim 16, wherein the pneumatic counterweight connector includes a pulley, a supporter, a reversing connector, a flexible part and a pin; wherein the pulley is connected to the supporter by the pin; the supporter is connected with the counterweight basket; and the flexible part is connected with the reversing connector and wound around the pulley.

* * * * *